US006771118B2

(12) United States Patent
Bittlestone et al.

(10) Patent No.: US 6,771,118 B2
(45) Date of Patent: Aug. 3, 2004

(54) SYSTEM AND METHOD FOR REDUCING A LEAKAGE CURRENT ASSOCIATED WITH AN INTEGRATED CIRCUIT

(75) Inventors: Clive D. Bittlestone, Allen, TX (US); Vipul K. Singhal, Bangalore Karnataka (IN)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/284,534

(22) Filed: Oct. 30, 2002

(65) Prior Publication Data

US 2004/0085121 A1 May 6, 2004

(51) Int. Cl.[7] ..... G05F 7/20; G05F 5/00
(52) U.S. Cl. ..... 327/544
(58) Field of Search ..... 327/544, 535; 365/226, 227, 228

(56) References Cited

U.S. PATENT DOCUMENTS 6,034,563 A * 3/2000 Mashiko ..... 327/544
6,320,453 B1 * 11/2001 Manning ..... 327/534
6,493,856 B2 * 12/2002 Usami et al. ..... 716/10
2002/0091978 A1 * 7/2002 Higashida ..... 365/205

* cited by examiner

*Primary Examiner*—Timothy P. Callahan
*Assistant Examiner*—Terry L. Englund
(74) *Attorney, Agent, or Firm*—Robert D. Marshall, Jr.; W. James Brady, III; Frederick J. Telecky, Jr.

(57) ABSTRACT

A method for reducing a leakage current in an integrated circuit is provided that includes controlling one or more inputs of an integrated circuit such that one or more logic elements within the integrated circuit are set to one or more selected values. The selected values produce a minimum leakage current associated with the integrated circuit when the integrated circuit is operating in a standby mode.

17 Claims, 2 Drawing Sheets

SYSTEM AND METHOD FOR REDUCING A LEAKAGE CURRENT ASSOCIATED WITH AN INTEGRATED CIRCUIT

TECHNICAL FIELD OF THE INVENTION

This invention relates in general to integrated circuit manufacturing and operation and more particularly to a system and method for reducing a leakage current associated with an integrated circuit.

BACKGROUND OF THE INVENTION

Data processing has become increasingly important in semiconductor environments. The ability to properly manipulate data or to process information is important for achieving an efficient communications protocol. It is similarly important to minimize power consumption during such processing tasks or operations. Attaining minimal power consumption may result in decreased power demands for an associated architecture and/or extended battery life for a corresponding system. In addressing such power issues, high processing speeds should not be sacrificed. As data processing operations and architectures have become increasingly complex, semiconductor manufacturers and designers encounter difficult challenges in attempting to process data quickly and efficiently while consuming minimal power.

Many integrated circuits may include several modes of operation. The general modes of operation may relate to power up and power down operations that provide or withhold power for a corresponding device, component, or element. Additionally, a standby mode or a suspended state may also be provided for such elements in order to minimize the power consumed or power demanded for the corresponding element during times of non-operation. This standby mode represents an area of semiconductor environments that is neglected in addressing current or power consumption issues.

SUMMARY OF THE INVENTION

From the foregoing, it may be appreciated by those skilled in the art that a need has arisen for an improved current reduction approach that provides the capability for devices or components to consume minimal power by producing minimum leakage currents in a standby mode. In accordance with one embodiment of the present invention, a system and method for reducing a leakage current associated with an integrated circuit are provided that substantially eliminate or greatly reduce disadvantages and problems associated with conventional current reduction techniques.

According to one embodiment of the present invention, there is provided a system for reducing a leakage current associated with an integrated circuit that includes controlling one or more inputs of an integrated circuit such that one or more logic elements within the integrated circuit are set to one or more selected values. The selected values produce a minimum leakage current associated with the integrated circuit when the integrated circuit is operating in a standby mode.

Certain embodiments of the present invention may provide a number of technical advantages. For example, according to one embodiment of the present invention, a current reduction approach is provided that generates minimum leakage current for an associated component or device. This is a result of a number of current reduction approaches that operate to minimize the power needed for a device or component when it is operating in a standby mode. One approach may include executing a program that identifies a minimum power state required and implementing such a program in a corresponding integrated circuit. Another approach may include the use of additional logic elements that may be used to shift designated binary values into corresponding elements in order to achieve a minimum leakage current level. Yet another approach may include the use of a sensor unit that detects a minimum leakage current value and then executes a series of scanning operations in order to position predetermined binary values into a corresponding integrated circuit. The binary values may control elements within the integrated circuit in order to produce a minimum leakage current value. Numerous other approaches to reducing a leakage current are provided herein and described in greater detail below.

Another technical advantage associated with one embodiment of the present invention relates to flexibility and ease of implementation into an existing device. Some of the current reduction approaches described herein may be implemented quickly in an existing structure with little effort and without significant modifications to existing components. Because elements such as sensor units, scan elements, and system controllers may be used to effectuate a minimum power drain for an associated device, little infrastructure is needed in order to achieve the targeted current level. Accordingly, an existing product, device, or component may benefit from the teachings of the present invention in that programs, software, or any other suitable elements may be used to produce the targeted minimum leakage current level. Embodiments of the present invention may enjoy some, all, or none of these advantages. Other technical advantages may be readily apparent to one skilled in the art from the following figures, description, and claims.

BRIEF DESCRIPTION OF THE DRAWINGS

To provide a more complete understanding of the present invention and features and advantages thereof, reference is made to the following description, taken in conjunction with the accompanying figures, wherein like reference numerals represent like parts, in which.

DETAILED DESCRIPTION OF THE INVENTION

Figure 1:
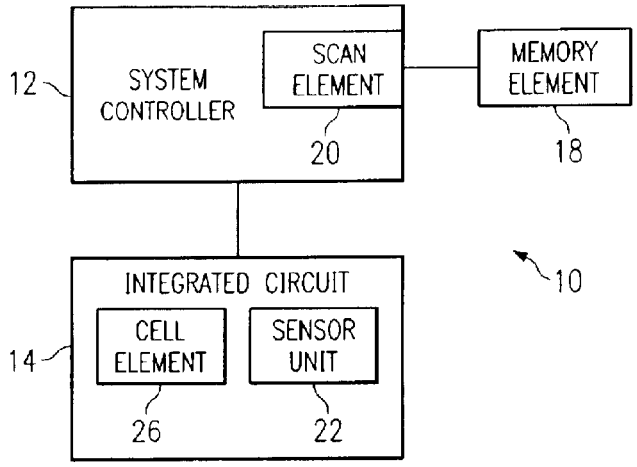
FIG. 1 is a simplified block diagram of a processing system for reducing a leakage current in an integrated circuit in accordance with one embodiment of the present invention.

FIG. 1 is a simplified block diagram of a processing system 10 for reducing a leakage current in a semiconductor environment. Processing system 10 includes a system controller 12, an integrated circuit 14, and a memory element 18. System controller 12 may include a scan element 20 and integrated circuit 14 may include a sensor unit 22 and/or a cell element 26. These elements may be included on a single integrated chip or, alternatively, any one or more of these elements may be provided independent of, or external to, a semiconductor device, chip, component, or element.

In accordance with the teachings of the present invention, system controller 12 operates to control a leakage current associated with integrated circuit 14 when integrated circuit 14 is in a standby mode. This may be accomplished using a number of approaches as described below, and, in some cases, may include the use of memory element 18, scan element 20, or sensor unit 22. Any one or more of these elements may cooperate with system controller 12 in order to set, manipulate, convert, or otherwise change logic elements, nodes, internal components, or binary information associated with integrated circuit 14 in order to minimize an associated leakage current.

Integrated circuit 14 may include a steady-state current. Integrated circuit 14 may also include a static current from an associated power supply or a battery, which contributes to a leakage current produced by the associated device, component, or element. This leakage current adversely impacts battery life for many components, such as portable electronic devices for example. Processing system 10 addresses this issue in enhancing battery life and limiting power consumption for an associated component, device, or element by reducing the leakage current for integrated circuit 14 when operating in a standby mode.

In addition, processing system 10 reflects an architecture that provides great flexibility in that system controller 12 may be quickly and easily implemented in a corresponding structure, such as integrated circuit 14 for example. Additionally, memory element 18, scan element 20, and sensor unit 22 may be used to effectuate a minimum power consumption value for an associated device with little corresponding infrastructure. Thus, an existing product, device, or component may benefit from such an implementation, while potentially only necessitating the addition of programs, software, or other suitable elements to be used in order to achieve a predefined leakage current objective.

System controller 12 is an element that operates to perform one or more scanning, storage, or control functions for integrated circuit 14 in accordance with one embodiment of the present invention. System controller 12 may be aware of data that, when properly input, produces a minimum leakage current value associated with integrated circuit 14. System controller 12 may gain information about the least leakage current value via scan element 20, memory element 18, sensor unit 22, or any other suitable object or element. Such information may be inclusive of binary patterns or software to be implemented such that a target device, such as integrated circuit 14, achieves a minimum leakage current state.

In operation of an example embodiment, system controller 12 may input binary information or logic data into integrated circuit 14 in order to produce the least leakage current state associated with integrated circuit 14. The information that is input may be communicated to the circuits, internal nodes, or logic elements included within integrated circuit 14. This inputting feature may be assisted by scan element 20, memory element 18, or any other suitable element. Integrated circuit 14 may then remain in the least leakage current state while it is operating in a standby mode.

When integrated circuit 14 is required to be active again, system controller 12 may reset the circuitry and/or internal objects within integrated circuit 14 such that it may commence normal operations. Data from normal operations may gleaned by scan element 20, sensor unit 22, or directly by system controller 12 and subsequently stored in any suitable location, such as memory element 18 for example. System controller 12 may include any suitable hardware, software, object, or element operable to facilitate the operations as described above.

Integrated circuit 14 is a semiconductor element having a leakage current associated therewith to be reduced by the approaches provided by processing system 10. In a particular embodiment of the present invention, integrated circuit 14 is a portable electronic device, such as a mobile phone for example, that includes a leakage current, which is produced when the mobile phone is operating in a standby mode. Alternatively, integrated circuit 14 may be any suitable device, component, hardware, software, element, object, or any other suitable unit that produces a leakage current. Integrated circuit 14 may be coupled to system controller 12 in any suitable fashion such as via a pin connection, a wire, a conductor, or any other appropriate communicative interface.

For purposes of teaching, it is important to understand the function of a standby mode (or suspended state) associated with integrated circuit 14. The standby mode may generally represent a field of inactivity, whereby the majority of integrated circuit 14 is not required to function. Integrated circuit 14 may be somewhat dormant, awaiting an interrupt notification or signal to initiate some form of activity. During a standby or power down mode, there is little (or negligible) circuit switching and the leakage power or leakage current is the major component of the total power dissipation. The leakage is generally state dependent, which translates into the amount of leakage current consumed being dependent on the state of integrated circuit 14. The state of integrated circuit 14 may be determined by the state of all memory elements (such as flip-flops, for example) that are implemented in integrated circuit 14 as well as the state of the primary inputs. For example, a five-input NAND gate may generally dissipate twenty-five times more leakage power when all inputs are HIGH in contrast to a state when all inputs are LOW.

Memory element 18 is a data storage unit that stores information to be accessed by system controller 12. Memory element 18 may include binary information or data segments to be read by system controller 12 and subsequently input into integrated circuit 14. Memory element 18 may receive such binary information or data segments from system controller 12, directly from integrated circuit 14, or via any other suitable source, location, component, or object. Alternatively, memory element 18 may store any other suitable data or information related to the reduction of a leakage current associated with integrated circuit 14. For example, memory element 18 may store one or more instructions for powering up or powering down integrated circuit 14 or system controller 12. In another example, memory element 18 may store a pattern or a routine that may be implemented in order to produce a minimum leakage current associated with integrated circuit 14.

In addition, memory element 18 may include a number of stored algorithms used to determine optimum binary settings within integrated circuit 14 that, when input into integrated circuit 14, produce a minimum level of leakage current. Memory element 18 may be any random access memory (RAM), read only memory (ROM), static random access memory (SRAM), field programmable gate array (FPGA), erasable programmable read only memory (EPROM), electrical erasable programmable read only memory (EEPROM), application-specific integrated circuit (ASIC), microcontroller, or microprocessor element, device, component, or object that operates to store data or information in an integrated circuit or semiconductor environment. Memory element 18 may include any suitable hardware, software, or program that organizes and selects data to be communicated from memory element 18 to system controller 12, or to any other suitable next destination.

In operation, system controller 12 may execute a number of processes or approaches in order to reduce the level of leakage current associated with integrated circuit 14. These processes may or may not require the use of memory element 18, scan element 20, or sensor unit 22. Certain processes may involve the use of some, all, or even none of these elements in cases where system controller 12 implements a protocol autonomously to generate a minimum leakage current.

Figure 2:
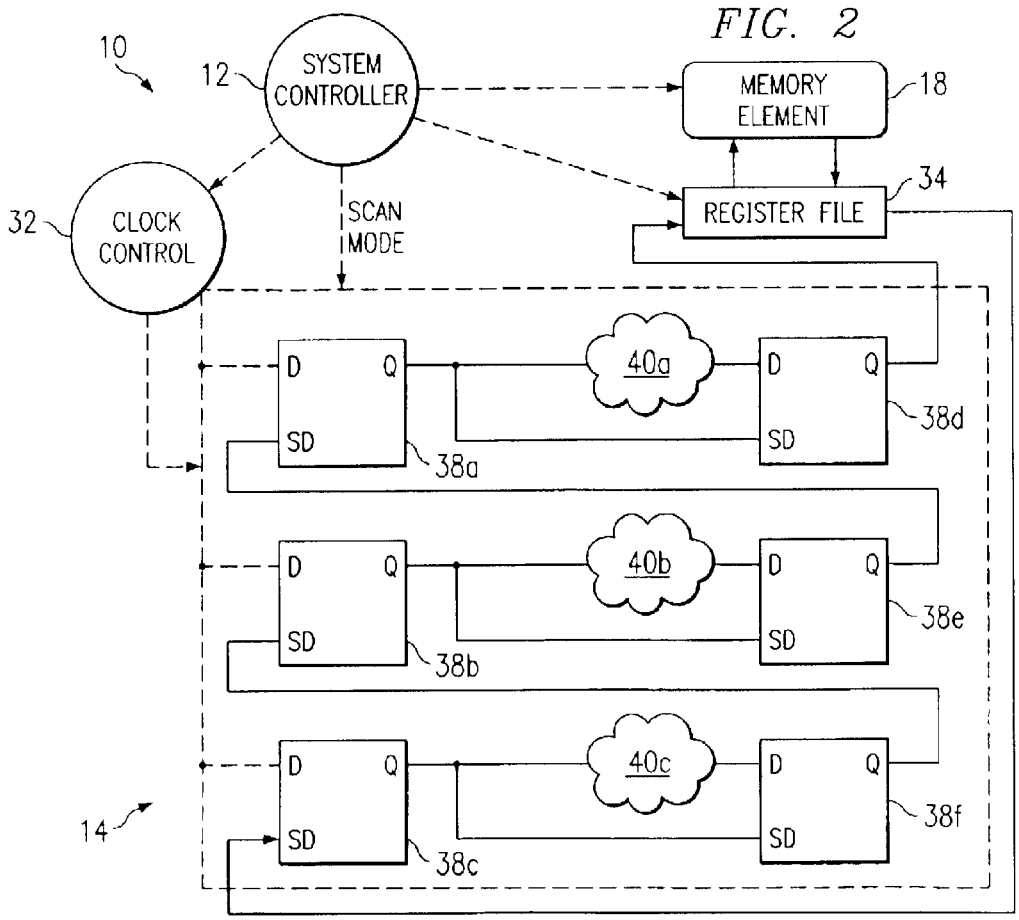
FIG. 2 is a simplified block diagram of an example implementation associated with the processing system in accordance with one embodiment of the present invention.

In accordance with an example embodiment of the present invention as illustrated in FIG. 2, system controller 12 may use a scanning operation (potentially utilizing scan element 20) to inject a set of binary values or logic information into integrated circuit 14 in order to set one or more logic elements 38*a–f* included therein. Logic elements 38*a–f* may be set in order to achieve an optimal logic state that produces a minimum leakage current. Information or data segments 40*a–c* may be exchanged or communicated between logic elements 38*a–f*. The example provided in FIG. 2 may also include a clock control 32 that may effectuate the timing for execution of one or more instructions associated with integrated circuit 14. A register file 34 may also be provided that communicates with memory element 18 and one or more of logic elements 38*a–f*.

The pattern that is scanned into the internal nodes or logic included within integrated circuit 14 may be predetermined and based on one or more simulations or designs developed using parameters similar to those reflected by integrated circuit 14. Thus, logic gates, registers, memory elements, buffers, and other suitable elements within integrated circuit 14 may be set by system controller 12 using scan element 20 (or any other suitable interface) such that a minimum leakage current is produced.

In accordance with another embodiment of the present invention, system controller 12 may use scan element 20 to shift out the current state data or information associated with a last working state of integrated circuit 14. This scanning may be executed prior to integrated circuit 14 entering into standby mode. This information may be stored as a pattern, a routine, a set of binary data, or in any other appropriate format. Additionally, such information may be stored in one or more system buffers (included within system controller 12, scan element 20, or memory element 18) from where it can be subsequently transferred to any suitable next destination, such as memory element 18 for example. When the internal circuitry or logic elements within integrated circuit 14 are needed for an operative mode, system controller 12 may again use scan element 20 to communicate the requisite information back to integrated circuit 14. This information may reflect the last working state of integrated circuit 14 and may further operate to set one or more nodes within integrated circuit 14 such that integrated circuit 14 may return to normal operation.

The scan mode feature of system controller 12 may use suitable compression and decompression techniques for data or information that is scanned to and from integrated circuit 14. System controller 12 may include microprocessors, hardware, software, or suitable logic operable to execute these compression/decompression techniques when scanning information associated with integrated circuit 14.

In operation of another embodiment of the present invention, logic optimization and synthesis tools may be used to identify various possible implementations of a functional logic block or to set one or more logic elements within integrated circuit 14. The logic optimization and synthesis tools may be used to check the minimum leakage state for each element within integrated circuit 14. The implementation that includes the least leakage current in its minimum leakage state may then be implemented. This scheme may be applicable to non-critical paths where propagation delay through the logic may not be a central consideration.

Thus, a suitable program may be executed that indicates the minimum power state required for integrated circuit 14 to reduce the amount of leakage current produced. A series of components (such as registers, flip-flops, logic elements, etc.) may then be used to control nodes within integrated circuit 14 in order to achieve an optimal power state. This program may be executed prior to saving information associated with integrated circuit 14 or at any other suitable time where appropriate. In addition, such a program may be executed autonomously without using scan element 20 or system controller 12. This program may also be executed using simulation techniques or design testing such that a minimum power state is identified, which may be used in controlling the internal structure of integrated circuit 14 in order to effectuate a minimum leakage current. For example, computer aided design (CAD) protocols, spice design simulations, or any other suitable design tools may be used to determine the logic patterns or binary information that is required to achieve a minimal level of leakage current.

This implementation capitalizes on the ease of switching logic elements within integrated circuit 14 into a power down mode. Because various types of logic elements may trigger different power strategies, a number of power optimizing decisions for achieving lower leakage current may be provided. Different types of logic may have inherently different behavior and power demands that will reduce leakage current more in some cases than in others. This may be related to the associated functionality of each of the logic elements.

In accordance with yet another embodiment of processing system 10, system controller 12 may configure itself as a linear feedback shift register (LFSR) and operate to shift various binary patterns or routines through associated logic elements in order to set integrated circuit 14 to a predetermined binary result. For each pattern simulated, a leakage current associated with integrated circuit 14 may be measured and compared to other leakage current results. This provides an auto-detection function that identifies the least leakage state for integrated circuit 14. In cases where (for a particular device) the least leakage state identified is different from what is predicted by simulation techniques, this may be indicative of a fabrication fault. Thus, the auto-detection feature of processing system 10 may be used as an enhancement to existing quiescent current (IDDQ) based fault testing techniques.

In implementing the above approach, a logic block or sensor unit 22 may be added to system controller 12, to integrated circuit 14, or provided in any other suitable location, such as external to any of these elements. The logic block or sensor unit 22 may use a random LFSR (as described above) to shift binary data into the shift registers or other elements of integrated circuit 14 and then monitor the leakage current that is produced.

This operation may be executed quickly in order to indicate that a selected pattern produces the least leakage current. Leakage patterns may shift over time because they are adaptive in semiconductor environments. Various types of transistors within integrated circuit 14 may cause such variations. A series of algorithms may also be included within sensor unit 22 or within the additional logic block such that immediate feedback associated with leakage current parameters is provided. Thus, sensor unit 22 may operate to immediately determine the optimum pattern for producing a minimum leakage current and either hold that information in an associated buffer or a suitable memory location or communicate the information associated with the optimum pattern to system controller 12 or memory element 18.

In operation of another example embodiment of processing system 10, control over leakage currents may be achieved by inserting additional logic into system controller 12 or integrated circuit 14. The additional logic may control critical internal nodes within the logic elements. Such a technique may be implemented using a software tool that determines which nodes would cause a significant reduction in leakage power based on a state change. Thus, a scanning operation may be executed (by scan element 20 for example) with the insertion of the extra logic that controls one or more nodes within integrated circuit 14. This operates to provide direct control of, or access to, nodes that may be otherwise difficult to manage because of their configuration within integrated circuit 14. Suitable software or hardware may be included within system controller 12 to provide this function.

In yet another example embodiment of operation, the lowest leakage power state may be pre-computed when the device or component is manufactured. In such an embodiment, scan element 20 may not be used. Cell element 26, or a piece of logic, such as a flip-flop for example, may be inserted into integrated circuit 14 with an extra pin that represents a power-down coupling. This may operate to give direct control or management capabilities to a portion of logic or to cell element 26 that was added. Thus, one or more control nodes may be manipulated such that a significant reduction in leakage current is achieved. This implementation may be shown with the use of two flip-flops where, when a power down mode is activated for integrated circuit 14, one flip-flop is set to '1, ' and when power up is initiated, one flip-flop is set to '0.' This may operate to maintain the state of integrated circuit 14 such that a scanning operation is not necessary. Such an embodiment may provide for low latency and little power consumption needed to execute the operation.

Figure 3:
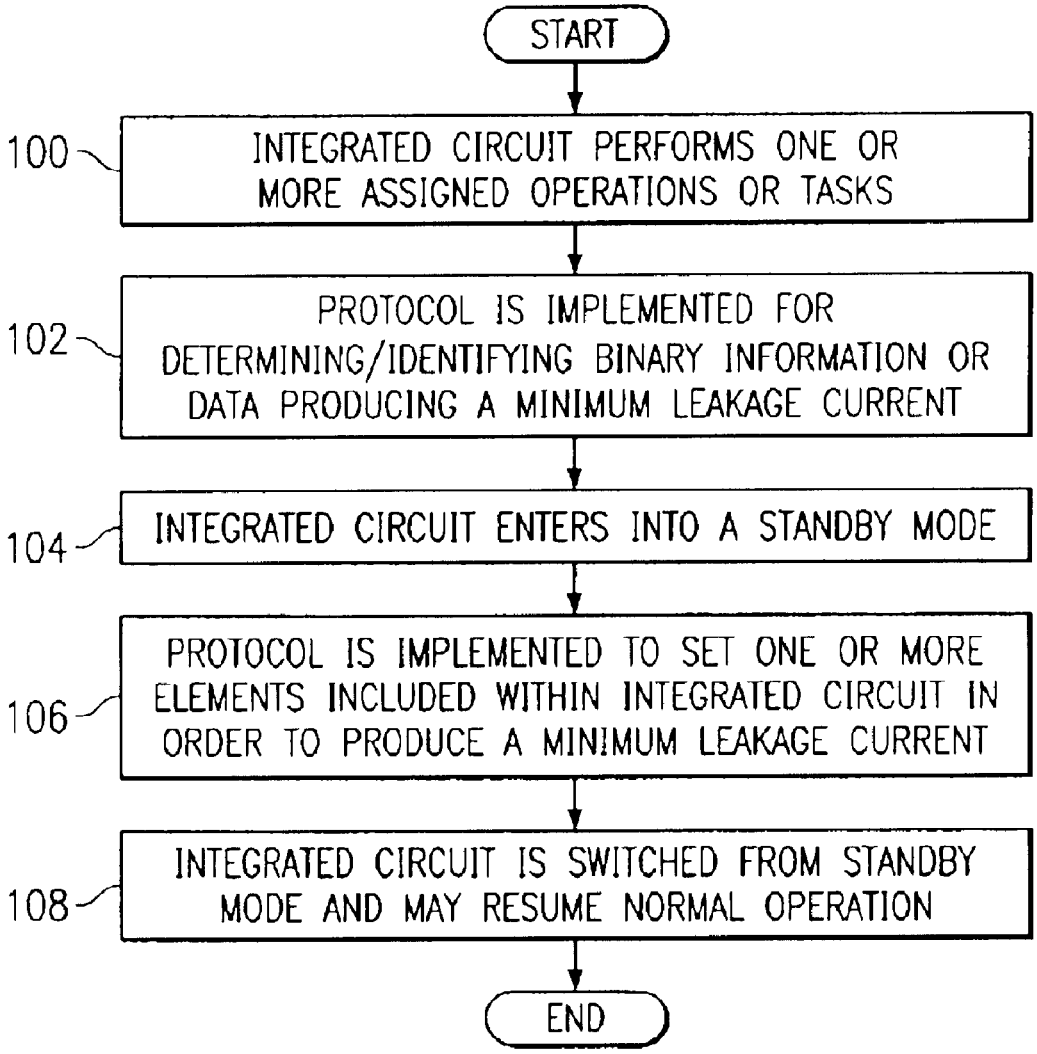
FIG. 3 is a flowchart illustrating a series of example steps associated with a method for reducing a leakage current associated with an integrated circuit.

FIG. 3 is a flowchart illustrating a series of example steps for reducing a leakage current associated with integrated circuit 14. The method begins at step 100, where integrated circuit 14 is performing one or more assigned operations or tasks. At step 102, a protocol may be implemented for determining binary information or logic data that produces a minimum leakage current. For example, a theoretical state for logic elements included within integrated circuit 14 may be determined based on simulation or design techniques. In another embodiment, the last working state may be gleaned and saved by system controller 12 or scan element 14. Alternatively, sensor unit 22 may execute one or more algorithms or patterns in order to evaluate which binary settings will produce an optimal leakage current when integrated circuit 14 is in a standby mode. Other embodiments, as described above, may be implemented in order to determine suitable binary data or any combination of these approaches may be implemented where appropriate and according to particular needs. At At step 104, integrated circuit 14 may enter into a standby mode or suspended state. This may be triggered by a clock signal or through any other suitable triggering mechanisms where appropriate. At step 106, a protocol may be implemented in order to set one or more elements included within integrated circuit 14. The elements may be set by scanning binary information into integrated circuit 14. Alternatively, the requisite binary information may be set by implementing additional logic that executes this task or with use of sensor unit 22. In addition, the logic elements may be set by controlling one or more nodes within integrated circuit 14 without any suitable element. At step 108, integrated circuit 14, or an associated device, component, or element that includes integrated circuit 14, may be triggered for power up mode. This may be executed using a suitable clock signal or via any other suitable initiating mechanism. Integrated circuit 14 may then resume normal operations in performing one or more tasks as designated or assigned.

Some of the steps illustrated in FIG. 3 may be changed or deleted where appropriate and additional steps may also be added to the flowchart. These changes may be based on specific semiconductor architectures, particular simulation arrangements, or configurations of associated elements within integrated circuit 14 and do not depart from the scope or the teachings of the present invention. For example, suitable binary information and data may be identified, evaluated, or otherwise determined at any suitable time. Design and simulation techniques may be employed when integrated circuit 14 is being manufactured such that appropriate binary information is ready to be implemented into integrated circuit 14 immediately after becoming operational.

Although the present invention has been described in detail with reference to particular embodiments, it should be understood that various other changes, substitutions, and alterations may be made hereto without departing from the spirit and scope of the present invention. For example, although the present invention has been described as operating in an integrated circuit environment, the present invention may be used in conjunction with any suitable chip, processing unit, CMOS technology, or any other element that seeks to process data while achieving a minimum leakage current. The example embodiments provided above are offered only for purposes of teaching and example and should not be construed to limit the scope of the invention in any way.

In addition, the arrangement as illustrated in FIG. 1 is somewhat arbitrary in that any combination of these elements may be utilized without departing from the scope of the present invention. For example, one or more of the elements illustrated in FIG. 1 may be included within integrated circuit 14 where appropriate. In addition, one or more of the elements, such as sensor unit 22, scan element 20, or memory element 18, may be included within system controller 12 or integrated circuit 14. Thus, many of the elements illustrated in FIG. 1 may be combined where appropriate and in accordance with particular needs. For example, memory element 18 may be included within system controller 12. In addition, system controller 12 may be included within integrated circuit 14 where appropriate.

Additionally, numerous other elements such as caches, interfacing units, registers, and other data processing, communication, or logic elements may be included within FIG. 1 or 2 or other embodiments described in order to facilitate the reduction of a leakage current for integrated circuit 14. In addition, any one or more of these elements may be coupled to suitable hardware, software, or components that facilitate the reduction of a leakage current in integrated circuit 14.

Numerous other changes, substitutions, variations, alterations, and modifications may be ascertained by those skilled in the art and it is intended that the present invention encompass all such changes, substitutions, variations, alterations, and modifications as falling within the spirit and scope of the appended claims. Moreover, the present invention is not intended to be limited in any way by any statement in the specification that is not otherwise reflected in the appended claims.

What is claimed is:

1. An apparatus for reducing a leakage current in an integrated circuit having a plurality of memory elements, each memory element of the plurality of memory elements storing a respective digital state, comprising:

a system controller coupled to the integrated circuit and operable to control one or more inputs of the integrated circuit such that each memory element of the plurality of memory elements within the integrated circuit is set to a corresponding digital state in order to produce a minimum leakage current associated with the integrated circuit when operating in a standby mode, wherein one or more of the corresponding digital states of the memory elements are determined by evaluating a minimal power value for a selected one or more of the memory elements within the integrated circuit, one or more of the corresponding digital states being scanned into the integrated circuit by a scan element included within the system controller, and wherein one or more of the corresponding digital states control one or more nodes associated with one or more of the memory elements in order to produce the minimum leakage current associated with the integrated circuit when operating in the standby mode.

2. An apparatus further for reducing a leakage current in an integrated circuit having a plurality of memory elements, each memory element of the plurality of memory elements storing a respective digital state, comprising:

a system controller coupled to the integrated circuit and operable to control one or more inputs of the integrated circuit such that each memory element of the plurality of memory elements within the integrated circuit is set to a corresponding digital state in order to produce a minimum leakage current associated with the integrated circuit when operating in a standby mode; and a sensor unit operable to monitor one or more leakage currents associated with the integrated circuit while in an operational mode in order to determine a pattern corresponding to one or more of the corresponding digital states, the sensor unit including a linear feedback shift register operable to scan one or more of the corresponding digital states into the integrated circuit in order to produce the minimum leakage current.

3. An apparatus for reducing a leakage current in an integrated circuit having a plurality of memory elements, each memory element of the plurality of memory elements storing a respective digital state, comprising:

a system controller coupled to the integrated circuit and operable to control one or more inputs of the integrated circuit such that each memory element of the plurality of memory elements within the integrated circuit is set to a corresponding digital state in order to produce a minimum leakage current associated with the integrated circuit when operating in a standby mode; and one or more algorithms embodied in a computer readable medium and operable to control one or more nodes included within the integrated circuit in order to produce the minimum leakage current associated with the integrated circuit.

4. An apparatus for reducing a leakage current in an integrated circuit having a plurality of memory elements, each memory element of the plurality of memory elements storing a respective digital state, comprising:

a system controller coupled to the integrated circuit and operable to control one or more inputs of the integrated circuit such that each memory element of the plurality of memory elements within the integrated circuit is set to a corresponding digital state in order to produce a minimum leakage current associated with the integrated circuit when operating in a standby mode; and a cell element operable to control one or more of the memory elements included within the integrated circuit in order to produce the minimum leakage current associated with the integrated circuit, the cell element including a power down pin coupling that is operable to communicate a signal that powers down the integrated circuit.

5. A method for reducing a leakage current in an integrated circuit having a plurality of memory elements, each memory element of the plurality of memory elements storing a respective digital state, comprising:

controlling one or more inputs of the integrated circuit such that one or more memory elements within the integrated circuit are set to a corresponding digital state in order to produce a minimum leakage current associated with the rated circuit when the integrated circuit is operating in a standby mode;

determining one or more of the corresponding digital states by evaluating a minimal power value for a selected one or more of the memory elements within the integrated circuit; and scanning one or more of the corresponding digital states into the integrated circuit, wherein one or more of the corresponding digital states control one or more nodes associated with one or more of the memory elements such that the minimum leakage current associated with the integrated circuit is produced.

6. A method for reducing a leakage current in an integrated circuit having a plurality of memory elements, each memory element of the plurality of memory elements storing a respective digital state, comprising:

controlling one or more inputs of the integrated circuit such that one or more memory elements within the integrated circuit are set to a corresponding digital state in order to produce a minimum leakage current associated with the integrated circuit when the integrated circuit is operating in a standby mode;

monitoring one or more leakage currents associated with one or more of the memory elements included within the integrated circuit in order to determine a pattern corresponding to one or more of the corresponding digital states; and scanning one or more of the corresponding digital states into the integrated circuit in order to produce the minimum leakage current.

7. A method for reducing a leakage current in an integrated circuit having a plurality of memory elements, each memory element of the plurality of memory elements storing a respective digital state, comprising:

controlling one or more inputs of the integrated circuit such that one or more memory elements within the integrated circuit are set to a corresponding digital state in order to produce a minimum leakage current associated with the integrated circuit when the integrated circuit is operating in a standby mode; and using one or more algorithms embodied in a computer readable medium to control one or more nodes included within the integrated circuit in order to produce the minimum leakage current associated with the integrated circuit.

8. A computer readable medium having code for reducing a leakage current in an integrated circuit having a plurality of memory elements, each memory element of the plurality of memory elements storing a respective digital state, the computer readable medium operable to:

control one or more inputs of the integrated circuit such that one or more of the memory elements within the integrated circuit are set to a corresponding digital state in order to produce a minimum leakage current associated with the integrated circuit when the integrated circuit is operating in a standby mode;

determine one or more of the corresponding digital states by evaluating a minimal power value for a selected one or more of the memory elements within the integrated circuit; and scan one or more of the corresponding digital states into the integrated circuit, wherein one or more of the corresponding digital states control one or more nodes associated with one or more of the memory elements such that the minimum leakage current associated with the integrated circuit is produced.

9. A computer readable medium having code for reducing a leakage current in an integrated circuit having a plurality of memory elements, each memory element of the plurality of memory elements storing a respective digital state, the computer readable medium operable to:

control one or more inputs of the integrated circuit such that one or more of the memory elements within the integrated circuit are set to a corresponding digital state in order to produce a minimum leakage current associated with the integrated circuit when the integrated circuit is operating in a standby mode;

monitor one or more leakage currents associated with one or more of the memory elements included within the integrated circuit in order to determine a pattern corresponding to one or more of the corresponding digital states; and scan one or more of the corresponding digital states into the integrated circuit in order to produce the minimum leakage current.

10. A computer readable medium having code for reducing a leakage current in an integrated circuit having, a plurality of memory elements, each memory element of the plurality of memory elements storing a respective digital state, the computer readable medium operable to:

control one or more inputs of the integrated circuit such that one or more of the memory elements within the integrated circuit are set to a corresponding digital state in order to produce a minimum leakage current associated with the integrated circuit when the integrated circuit is operating in a standby mode; and use one or more algorithms to control one or more nodes included within the integrated circuit in order to produce the minimum leakage current associated with the integrated circuit.

11. A computer readable medium having code for reducing a leakage current in an integrated circuit having a plurality of memory elements, each memory element of the plurality of memory elements storing a respective digital state, the computer readable medium operable to:

control one or more inputs of the integrated circuit such that one or more of the memory elements within the integrated circuit are set to a corresponding digital state in order to produce a minimum leakage current associated with the integrated circuit when the integrated circuit is operating in a standby mode; and communicate with a cell element included within the integrated circuit, the cell element being operable to control one or more of the memory elements included within the integrated circuit in order to produce the minimum leakage current associated with the integrated circuit, the cell element including a power down pin coupling that is operable to communicate a signal that powers down the integrated circuit.

12. An apparatus for reducing a leakage current in an integrated circuit having a plurality of memory elements, each memory element of the plurality of memory elements storing a respective digital state, comprising:

a system controller coupled to the integrated circuit and operable to control one or more inputs of the integrated circuit such that each memory element of the plurality of memory elements within the integrated circuit is set to a corresponding digital state in order to produce a minimum leakage current associated with the integrated circuit when operating in a standby mode;

a memory storing state data of the corresponding digital state for each memory element of the plurality of memory elements in order to produce the minimum leakage current; and wherein the memory elements of the plurality of memory elements of the integrated circuit are connectable together into a serial scan chain; and wherein the system controller is operable to set each memory element of the plurality of memory elements within the integrated circuit to the corresponding digital state in order to produce the minimum leakage current by scanning the state data stored in the memory into the serial scan chain.

13. The apparatus of claim 12, wherein:

the system controller is further operable to scan out of the integrated circuit via the serial scan chain a last working state before operating in the standby mode and storing this last working state in the memory, and scan into the, integrated circuit via the serial scan chain the last working state stored in the memory upon switching from the standby mode to a power up mode.

14. A method for reducing a leakage current in an integrated circuit having a plurality of memory elements, each memory element of the plurality of memory elements storing a respective digital state, comprising:

controlling one or more inputs of the integrated circuit such that one or more memory elements within the integrated circuit are set to a corresponding digital state in order to produce a minimum leakage current associated with the integrated circuit when the integrated circuit is operating in a standby mode;

storing state data of the corresponding digital state for each memory element of the plurality of memory elements in order to produce the minimum leakage current; and connecting the memory elements of the plurality of memory elements of the integrated circuit together into a serial scan chain; and controlling one or more inputs of the integrated circuit to set the memory elements of the plurality of memory elements to their corresponding digital states to produce the minimum leakage current by scanning the stored state data into the serial scan chain.

15. The method of claim 14, further comprising:

scanning out of the integrated circuit via the serial scan chain a last working state before operating in the standby mode and storing this last working state in the memory; and scanning into the integrated circuit via the serial scan chain the last working state stored in the memory upon switching from the standby mode to a power up mode.

16. A computer readable medium having code for reducing a leakage current in an integrated circuit having a plurality of memory elements, each memory element of the plurality of memory elements storing a respective digital state, the computer readable medium operable to:

control one or more inputs of the integrated circuit such that one or more of the memory elements within the integrated circuit are set to a corresponding digital state in order to produce a minimum leakage current associated with the integrated circuit when the integrated circuit is operating in a standby mode;

store state data of the corresponding digital state for each memory element of the plurality of memory elements in order to produce the minimum leakage current; and control one or more inputs of the integrated circuit to set the memory elements of the plurality of memory elements to their corresponding digital states in order to produce a the minimum leakage current by scanning the stored state data stored into the one or more memory elements.

17. The computer readable medium of claim 16, further operable to:

scan out of the integrated circuit a last working state before operating in the standby mode and storing this last working state in a memory; and scan into the integrated circuit the last working state stored in the memory upon switching from the standby mode to a power up mode.

* * * * *